United States Patent [19]

Blaylock

[11] 4,075,794

[45] Feb. 28, 1978

[54] HONING TOOL

[76] Inventor: John A. Blaylock, 7983 Blackshire Drive, Huber Heights, Dayton, Ohio 45424

[21] Appl. No.: 674,212

[22] Filed: Apr. 6, 1976

[51] Int. Cl.[2] ..... B24B 33/04; B24D 17/00

[52] U.S. Cl. ..... 51/340; 51/204; 51/343; 51/351

[58] Field of Search ..... 51/338, 339, 340, 343, 51/344, 345, 350, 351, 352, 353, 204, 342

[56] References Cited

U.S. PATENT DOCUMENTS

| | | | |
|---|---|---|---|
| 1,828,074 | 10/1931 | Roebbel | 51/340 |
| 2,302,207 | 11/1942 | Gjertsen | 51/339 |
| 2,349,994 | 5/1944 | Snader | 51/338 |
| 2,419,297 | 4/1947 | Steigerwald | 51/345 |
| 3,075,323 | 1/1963 | Weir | 51/338 |
| 3,507,077 | 4/1970 | Magsig | 51/338 |
| 3,672,102 | 6/1972 | Johnson | 51/204 |
| 3,711,260 | 1/1973 | Kramm | 51/338 |
| 3,727,352 | 4/1973 | Palazzi | 51/344 |

*Primary Examiner*—Harold D. Whitehead
*Assistant Examiner*—Nicholas P. Godici
*Attorney, Agent, or Firm*—Walter Becker

[57] ABSTRACT

A honing tool having a mandrel with longitudinal grooves each of which has an inclined bottom slidably engaged by a correspondingly wedge-shaped honing stone. The honing stones partially project through windows in a sleeve and by these windows are held stationary in their longitudinal direction while being able to move radially with regard to the sleeve when the mandrel moves in either longitudinal direction. The longitudinal adjustment of the mandrel relative to the sleeve is effected by a spindle which threadedly engages the mandrel in its axial direction and is rotatable by hand in either direction to thereby either move the spindle in one or the other longitudinal directions. In response to such longitudinal movement of the mandrel, the honing stones are adjusted radially either outwardly or inwardly, to increase or decrease the honing diameter. The mandrel is under continuous pressure by a spring in the sleeve with this pressure acting in one of its axial directions to thereby urge the mandrel to axially move in one or the other direction while simultaneously exerting a radial uniform pressure and when possible radial movement of the honing stones to thereby maintain the honing pressure exerted upon the wall of the bore to be honed.

9 Claims, 5 Drawing Figures

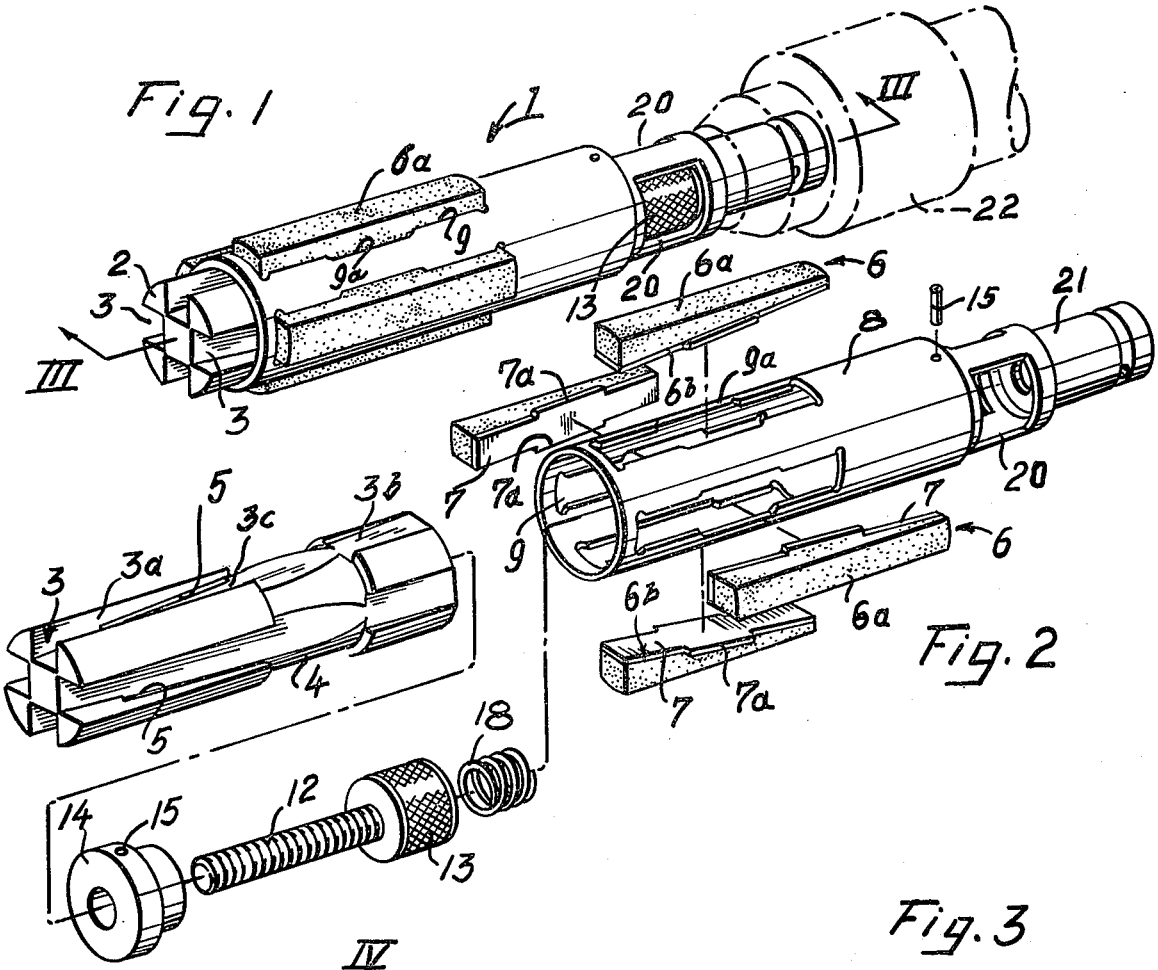
Fig. 2
Fig. 3
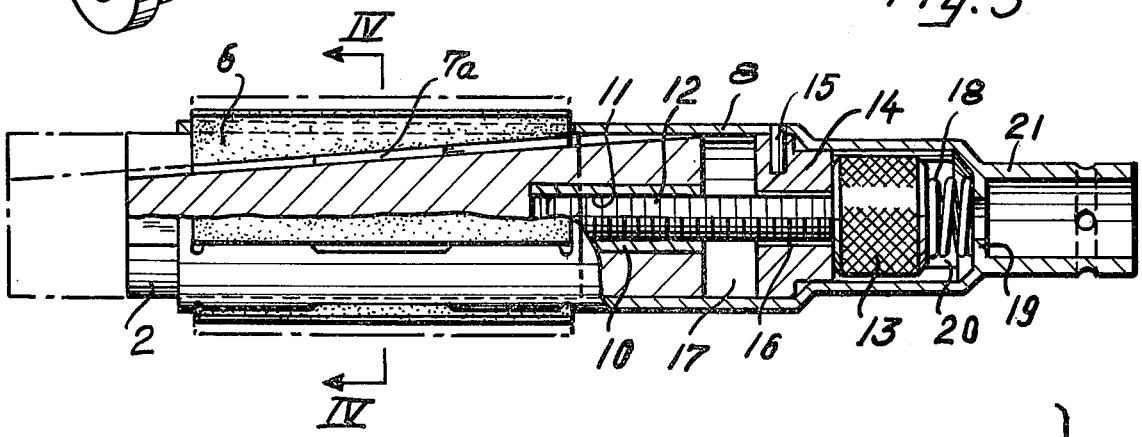
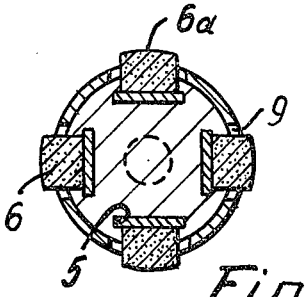
Fig. 4
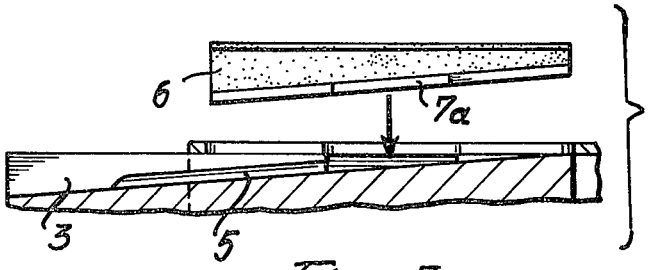
Fig. 5

HONING TOOL

The present invention relates to honing tools having a mandrel with honing stones therein. With heretofore known honing tools of this type, the mandrel has as many grooves extending in the longitudinal direction of the mandrel as there are honing stones. Each groove increases in depth toward that end of the mandrel which during a honing operation first enters the bore to be honed. The thickness of the honing stones in the respective groove decreases correspondingly in the direction away from said last mentioned end of the mandrel so that, when the mandrel is moved in the longitudinal direction relative to the respective stones in said grooves in one direction, the stones are moved radially outwardly, and when the mandrel is moved in the other or opposite direction, the stones are moved radially inwardly.

With this heretofore known arrangement, the stones are during the adjustment thereof and during honing operations prevented from moving in the longitudinal direction of the mandrel. This is effected by heavy holding wires which are connected on one hand to the honing stones and on the other hand are anchored in large and heavy machinery which also includes fluid operable cylinder-piston means continuously exerting pressure upon the mandrel in the longitudinal direction thereof, and urging the same to move relative to the honing stones in the above mentioned one direction so as to cause the honing stones to move radially outwardly. Machinery of this known type is rather complicated and expensive, and also the installation of the honing tools in and their removal from the mandrel is rather time consuming and expensive in view of the hook-up of the honing stones with said machinery.

It is, therefore, an object of the present invention to provide a portable honing tool which will overcome the above mentioned drawbacks, can be used in connection with ordinary power or manually operated machines, e.g. manually operated drill presses, will do away with any holding wires to hold the stones, and does not require any cylinder-piston systems for automatically maintaining the radial pressure at which the honing stones act upon the bore walls to be honed.

It is another object of this invention to provide a portable honing tool as set forth in the preceding paragraph, which will greatly facilitate assembling and holding the honing stones in the mandrel and will also facilitate the removal of the honing stones from the tool, and thereby the exchange of the honing stones.

These and other objects and advantages of the invention will appear more clearly from the following specification in connection with the accompanying drawing, in which:

FIG. 1 is an isometric view of a honing tool according to the present invention.

FIG. 2 represents an exploded view of the honing tool of FIG. 1.

FIG. 3 is a fragmentary longitudinal section through the honing tool of FIG. 1, said section being taken along the line III—III of FIG. 1.

FIG. 4 is a cross section taken along the line IV—IV of FIG. 3.

FIG. 5 illustrates the assembly of a honing stone in the mandrel.

The honing tool according to the present invention is characterized primarily by a mandrel provided with a plurality of longitudinal grooves extending in the longitudinal direction of the mandrel, in evenly spaced arrangement around the axis of the mandrel. Each of said grooves has a honing stone arranged therein, and means are provided for positively slidingly interconnecting the respective groove and honing stone therein so as to permit a longitudinal movement of said mandrel relative to said stones. The mandrel is slidably held in a sleeve member provided with windows through which the stones extend. While the stones are by said windows prevented from moving in the longitudinal direction of said sleeve member, the mandrel is axially slidable in said sleeve member and is axially adjustable therein by adjusting means arranged in said sleeve member so as to move the honing stones selectively radially either outwardly or inwardly. Within said sleeve member in an end portion thereof, there are provided spring means continuously acting upon the adjacent end of said mandrel so as to urge the latter in a direction out of the sleeve at that end thereof which is remote from said spring means. In this way, the honing stones are continuously held radially under pressure and in honing contact with the respective bore to be honed by the honing tool according to the invention.

Referring now to the drawing in detail, the honing tool 1 shown therein comprises a mandrel 2 which in the specific example shown in the drawing is provided with four main grooves 3 extending in the direction of the longitudinal axis of the mandrel. However, it should be noted that, if desired, more or less than four grooves 3 may be provided in the mandrel 2 without in any way affecting the essence of the present invention. As will be seen from the drawing, and in particular from FIG. 3, each of the grooves 3 steadily and continuously decreases in height from the left hand end of the drawing, which is the mandrel end first to enter a bore to be honed, in the direction toward the other end of the mandrel, which other end cooperates with adjusting means that will be described further below.

As will furthermore be seen from the drawing, especially FIG. 2, each of the grooves 3 has a longer section 3a and a shorter section 3*b* separated from each other by a neck 4 while the bottom 3*c* of each groove 3 extends all the way from one groove section 3*a* to the other groove section 3*b*. It should, however, be noted that the groove section 3*b* is actually not necessary and is merely due to the way in which the mandrel is preferably made. More specifically, the mandrel is preferably made from round stock material, e.g. aluminum (if necessary turned to the desired diameter), into which the grooves 3 are milled, whereupon the neck 4 is cut dividing each groove 3 into a groove section 3*a* and a groove section 3*b*.

The outer diameter of neck 4 is less than the outer diameter of the mandrel 2. Each groove section 3*a* is at the level of its bottom provided with a lip groove 5 for a purpose that will presently be explained. In each groove section 3*a* there is arranged a honing stone 6 which has an outer surface 6*a* curved in conformity with the diameter of the bore to be honed, and also has an inner plane surface 6*b* to which is fastened in any convenient manner, e.g. cemented, a plane thin guiding plate 7, e.g. of metal or plastic material. As will be particularly clearly seen from FIG. 2, this guiding plate 7 has a lip 7*a* protruding laterally at both sides of the respective honing stone 6, while the remainder of plate 7 does not laterally protrude beyond the sides of the honing stone. In assembled condition of the tool, lip 7*a* slidably engages lip groove 5 as shown in FIG. 4. Inasmuch as the bottom 3*c* of each groove 3 forms with the longitudinal axis of the mandrel 2 an acute angle substantially equalling the acute angle formed by the bottom of each plate 7 with the longitudinal central line of the curved outside surface 6*a* of the pertaining honing stone 6, it will be appreciated that the cylindrically curved outside honing surfaces of all honing stones will in all equal radial positions of the honing stones relative to the mandrel form part of a cylinder the longitudinal axis of which coincides with the longitudinal axis of the mandrel. Expressed differently, in all equal radial positions of the honing stones relative to the pertaining groove 3 of mandrel 2, the outer cylindrically curved surfaces of said honing stones define with each other a straight cylindrical surface.

The mandrel 2 according to the invention is mounted in a honing stone retaining sleeve 8.

This sleeve has as many retaining slots or windows 9 as there are main grooves 3 in the mandrel, said windows or slots 9 being in alignment with said main grooves 3 when the tool is properly and completely assembled. The length and width of each of said retaining windows 9 only slightly exceed the length and width of the respective honing stone 6, just so that the stone fits with slide fit in the pertaining window 9.

One section 9*a* of the windows 9, namely that section which, when the stones are in the position in which they are to be assembled, corresponds to the location of guiding lip 7*a*, is slightly wider than the total width from the outer edge of one lip to the outer edge of the other or opposite lip. In this way it will be possible, when assembling the tool, to pass the lip 7*a* forming a portion of the wider part of the guiding or bottom plate 7, with slide fit through the widened window portion 9*a* of sleeve 8 into the respective adjacent groove 3, provided, of course, that one of the main grooves 3 is aligned with one of the windows, and provided the length of neck 4 which is slightly longer than window section 9*a* is axially and radially aligned with window section 9*a* (see FIG. 5). From the above it will be appreciated that in order to insert the honing stones 6 into the tool, the mandrel is introduced into the left hand side (with regard to FIG. 3) of sleeve 8 so that the neck 4 enters sleeve 8 ahead of groove section 3*a*. The window 9 is then brought into radial alignment with any one of the grooves 3 while the window section 9*a* is at the same time to be in radial alignment with the neck 4. When these relative positions have been established, the respective honing stones 6 can be dropped through the respective window section 9*a* into groove sections 3*a* and 3*b* and onto neck 4. When now displacing mandrel 2 in the axial direction thereof in rightward direction (with regard to the drawing), in other words so as to move the mandrel 2 axially relative to the sleeve 8 into the latter, the lips 7*a* of the guiding plates 7 enter the respective adjacent lip groove 5 thereby positively holding the honing stones in sliding engagement with the mandrel 2 and preventing them from dropping out through the windows 9, 9*a* while the mandrel 2 by means of said windows 9 holds the honing stones 6 stationary with regard to grooves 3 when the mandrel is being displaced in either longitudinal direction thereof, i.e. in the direction into or out of sleeve 8. It will also be appreciated that due to the grooves 3 tapering in one direction and the honing stones 6 in said grooves 3 tapering in the opposite direction, the displacement of the mandrel relative to sleeve 8 will result in the honing stones being moved radially inwardly or outwardly depending on the direction of axial movement of the mandrel relative to the sleeve 8. During such operation, the honing stones 6 are firmly retained in longitudinal sliding engagement with the mandrel 2 by the sliding lips 7*a* of guiding plates 7, which lips are connected to the bottom of the respective honing stones by slidably engaging the pertaining lip groove 5 in the walls at the bottom of the main grooves 3. Inasmuch as all grooves 3 are identical and all honing stones in the mandrel are identical, it will be appreciated that all honing stones move synchronously and to the same extent radially inwardly or outwardly in response to an axial movement of mandrel 2 relative to sleeve 8 and that thus the outer periphery of said stones describes a true and the same cylinder fitting the wall to be honed during a rotation of the honing tool.

There will now be described the mechanism for effecting an axial adjustment of the mandrel 2 relative to sleeve 8. With reference to FIG. 3, it will be seen that the right hand end (with regard to the drawing) of mandrel 2 has a hollow cylindrical insert 10 which is coaxial with mandrel 2 and is press fitted therein. This insert 10 is provided with an inner thread 11 threadedly engaged by a threaded bolt or spindle 12 having a knurled head 13 fixedly connected thereto. Adjacent said knurled head 13 and between the latter and the mandrel 2 is provided an abutment ring 14 which by means of a pin 15 is fixedly connected to sleeve 8 and has a central thread-free bore 16 of a diameter greater than the diameter of thread 11. The space 17 between that end face of mandrel 2 which faces abutment ring 14 and abutment ring 14 varies with the axial adjustment of the mandrel 2. From the above it will be evident that if the knurled head 13 is turned in one direction, spindle 12 will move mandrel 2 away from abutment ring 14 toward the left with regard to FIG. 3, whereas rotation of knurled head 13 in the opposite direction will cause spindle 12 to move the mandrel 2 toward the abutment ring 14. As mentioned above, movement of mandrel 2 in one or the opposite axial direction will cause the honing stones to move radially outwardly or inwardly respectively.

In order to assure that the honing tool 1 will within the limits of each adjustment automatically take care of any peripheral wear of the honing stones 6, a spring 18 is inserted between knurled head 13 and a fixed, preferably perforated web 19 fixedly connected to the sleeve 8. This spring 18 continuously urges head 13 and thereby through spindle 12 mandrel 2 toward the left (with regard to FIG. 3) and thereby radially displaces the honing stones toward the wall to be honed to the extent to which the periphery of said honing tool was worn. That portion of the sleeve 8 which surrounds the knurled head 13 is provided with two windows 20 (FIG. 1) which allow two fingers of an operator to reach and manipulate, i.e. turn, the knurled head 13 in either direction to thereby selectively adjust the mandrel 2 in either longitudinal direction and relative to the sleeve 8 and to thereby effect a radial adjustment of the honing stones 6 in outward and inward direction.

Finally, the sleeve 8 is provided with a tubular extension 21 extending from web 19 and adapted to receive an adaptor 22 for connection with an ordinary power or hand operated machine, e.g. drill press. The adapter 22 which may be of any suitable type and does not form a part of the present invention may be connected to the mandrel extension 21 in any convenient manner.

It is, of course, to be understood that the present invention is, by no means, limited to the specific showing in the drawing but also comprises any modifications within the scope of the appended claims.

What I claim is:

1. A honing tool which includes: a cylindrical mandrel having a plurality of longitudinal grooves therein distributed in laterally spaced relationship to each other around the longitudinal axis of said mandrel, each of said grooves having a bottom and also having side walls with retaining groove means therein extending in the longitudinal direction of said grooves, the bottom of all of said grooves having the same overall inclination in the longitudinal direction of said grooves relative to said longitudinal axis of said mandrel so that the depth of each of said grooves decreases at the same ratio from one end of the respective groove in the direction toward the other end thereof, a plurality of honing elements corresponding in number to the number of said grooves and being mounted therein, each of said honing elements including a honing stone having an outer longitudinal abrasive surface and also having side walls forming with said outer abrasive surface longitudinally extending edges substantially parallel to the axis of said mandrel, each of said honing elements also including a stone carrier firmly connected to the pertaining stone and having a bottom surface slightly engaging the bottom of the pertaining groove so as to permit said mandrel to slide in the longitudinal direction thereof relative to said honing elements, each of said stone carriers having on opposite sides thereof lateral projections slidingly engaging the retaining groove means in the pertaining side walls of said grooves for maintaining the pertaining honing element and said mandrel radially interengaged over a predetermined axial sliding movement of said mandrel relative to said honing elements in conformity with the desired possible maximum radial adjustment of said honing elements relative to the longitudinal axis of said mandrel, a single piece unitary sleeve surrounding and directly engaging said mandrel with slide fit to permit an axial displacement of said mandrel relative to said sleeve, said sleeve being provided with window means respectively permitting said honing elements radially to pass therethrough with slide fit while preventing axial displacement of said honing stones relative to said sleeve, each of said grooves having aligned therewith a mandrel section arranged adjacent the respective groove end with the least depth and flush with the respective adjacent groove bottom and extending in the axial direction of said mandrel over a length which is in excess of the length of each of said lateral projections, said mandrel section having a width in excess of the total width spanned by each two lateral projections on oppostie sides of one the the same stone carrier, adjusting means operatively connected to said mandrel and manually operable for effecting an axial movement of said mandrel in said sleeve, and means operatively connected to said adjusting means and operable to continuously urge said mandrel to axially move in a direction in which during said movement groove areas of greater depth are being withdrawn from said honing elements and replaced by groove areas of less depth.

2. A tool according to claim 1, in which the bottom of each groove and the bottom surface of each honing element in each groove is plane.

3. A tool according to claim 1, in which each honing element comprises an abrasive section including said outer abrasive surface, and also comprises a bottom plate forming said stone carrier.

4. A tool according to claim 3, in which said lateral projections form a single integral part with said bottom plate.

5. A honing tool which includes: a cylindrical mandrel having a plurality of longitudinal grooves therein distributed in laterally spaced relationship to each other around the longitudinal axis of said mandrel, each of said grooves having a bottom surface and also having side walls with retaining groove means therein extending in the longitudinal direction of said side walls, one side of said groove means being substantially flush with the respective adjacent bottom of the pertaining groove, the bottom surface of all of said grooves having the same overall inclination in the longitudinal direction of said grooves relative to said longitudinal axis of said mandrel so that the depth of each of said grooves decreases at the same ratio from one end of the respective groove in the direction toward the other end thereof, a plurality of wedge-shaped honing elements corresponding in number to the number of said grooves and being respectively arranged in said grooves so that each respective honing element has its thickest section closer to the deepest section of the pertaining groove than its thinnest section, each of said honing elements including a honing stone with an outer abrasive surface and also including a stone carrier firmly connected to the pertaining honing stone and having a bottom surface in sliding engagement with the bottom surface of the pertaining groove, each of said carriers being provided with lateral projections slidingly engaging said retaining groove means, a single base unitary sleeve surrounding and directly engaging said mandrel with slide fit to permit an axial displacement of said mandrel relative to said sleeve said sleeve being provided with window means corresponding in number to the number of said honing elements, and each of said window means having a width and length so as to slide-fit the pertaining honing stone and carrier including the lateral projections thereof.

6. A tool according to claim 5, which includes abutment means fixedly connected to one end portion of said sleeve and provided with a bore extending in axial alignment with the longitudinal axis of said mandrel, that end portion of said mandrel which is closest to said abutment means being provided with a threaded bore in axial alignment with said bore in said abutment means, one side of said abutment means facing that end of said mandrel which is provided with said threaded bore and the opposite side of said abutment means facing away from said last mentioned mandrel end, a threaded spindle passing from that side of said abutment means which faces away from said mandrel through said bore in said abutment means into meshing engagement with said threaded bore in said mandrel, and a head connected to that end of said spindle which is remote from said threaded bore in said mandrel, said head being manually operable to selectively turn said spindle in either direction to correspondingly move said mandrel relative to said sleeve in one or the opposite axial direction of said sleeve.

7. A tool according to claim 6, in which that end of said sleeve which is adjacent said head is provided with an extension for receiving an adaptor for chucking said tool into a machine tool.

8. A tool according to claim 7, in which said extension includes abutment means axially spaced from said head, and which includes spring means interposed between said head and said last mentioned abutment means and continuously urging said mandrel to move axially relative to said sleeve away from said extension to thereby urge said honing stones radially outwardly.

9. A longitudinally shaped honing element for use in a portable honing tool which honing element is wedge-shaped and has an abrasive section with an abrasive outer surface and also has a longitudinally shaped carrier member firmly connected to said abrasive section and provided on its longitudinal sides with longitudinally extending plane flat projections arranged between and in spaced relationship to the ends of said carrier member.

* * * * *